US009647334B2

(12) United States Patent
Lanciault et al.

(10) Patent No.: US 9,647,334 B2
(45) Date of Patent: May 9, 2017

(54) WIDE SCAN STEERABLE ANTENNA

(71) Applicant: MacDonald, Dettwiler and Associates Corporation, Ste-Anne-de-Bellevue (CA)

(72) Inventors: François Lanciault, Blainville (CA); Philippe Loiselle, Montréal (CA); Richard Horth, Kirkland (CA); Éric Darnel, Hudson (CA); Mathieu Riel, Lachine (CA)

(73) Assignee: MacDonald, Dettwiler and Associates Corporation, Ste-Anne-de-Bellevue, QC (CA)

( * ) Notice: Subject to any disclaimer, the term of this patent is extended or adjusted under 35 U.S.C. 154(b) by 69 days.

(21) Appl. No.: 14/849,919

(22) Filed: Sep. 10, 2015

(65) Prior Publication Data

US 2016/0072185 A1 Mar. 10, 2016

Related U.S. Application Data

(60) Provisional application No. 62/048,302, filed on Sep. 10, 2014.

(51) Int. Cl.

| | |
|---|---|
| ***H01Q 3/20*** | (2006.01) |
| ***H01Q 3/08*** | (2006.01) |
| ***H01Q 3/16*** | (2006.01) |
| ***H01Q 19/13*** | (2006.01) |
| ***H01Q 19/19*** | (2006.01) |

(52) U.S. Cl.

CPC ..... *H01Q 3/20* (2013.01); *H01Q 3/08* (2013.01); *H01Q 3/16* (2013.01); *H01Q 19/134* (2013.01); *H01Q 19/191* (2013.01)

(58) Field of Classification Search

CPC H01Q 3/005; H01Q 3/02; H01Q 3/04; H01Q 3/08; H01Q 3/12; H01Q 3/16; H01Q 3/18; H01Q 3/20; H01Q 19/134; H01Q 19/191

USPC ..... 343/757, 758, 759, 761, 763, 765

See application file for complete search history.

(56) References Cited

U.S. PATENT DOCUMENTS

| | | | | | |
|---|---|---|---|---|---|
| 2,407,310 | A * | 9/1946 | Lundy | H01Q 3/08 | 192/33 R |
| 2,512,636 | A * | 6/1950 | Flynt | G10K 11/355 | 181/125 |
| 2,930,255 | A * | 3/1960 | Bryson | H01Q 3/08 | 343/757 |
| 3,530,477 | A * | 9/1970 | Jarrett | H01Q 3/08 | 343/765 |
| 3,845,483 | A * | 10/1974 | Soma | H01Q 19/191 | 343/761 |
| 4,044,361 | A * | 8/1977 | Yokoi | H01P 3/20 | 343/754 |

(Continued)

*Primary Examiner* — Dameon E Levi
*Assistant Examiner* — Patrick Holecek
(74) *Attorney, Agent, or Firm* — Praxis & Equinox; Franz Bonsang

(57) ABSTRACT

A steerable antenna configuration having all actuators and the feed source mounted on a stationary side of the antenna thereby eliminating the need of having to supply power and/or communication signal through, a rotation mechanism. A first actuator rotates a reflector assembly about a first axis, and a second actuator rotates at least a main reflector of the reflector assembly about a second axis perpendicular to the first axis. The second axis is rotatable about the first axis via the first actuator.

16 Claims, 12 Drawing Sheets

(56) References Cited

U.S. PATENT DOCUMENTS

| | | | | |
|---|---|---|---|---|
| 4,832,002 | A * | 5/1989 | Medina | F24J 2/16 126/577 |
| 5,796,370 | A * | 8/1998 | Courtonne | H01Q 3/16 343/761 |
| 6,492,955 | B1 * | 12/2002 | Amyotte | H01Q 3/20 343/755 |
| 8,059,048 | B2 * | 11/2011 | Felstead | H01Q 3/08 343/766 |
| 9,054,409 | B2 * | 6/2015 | Zimmerman | H01Q 3/08 |
| 9,093,742 | B2 * | 7/2015 | Choiniere | H01Q 3/08 |
| 2010/0245196 | A1 * | 9/2010 | Miron | H01Q 3/02 343/763 |
| 2011/0043433 | A1 * | 2/2011 | Klien | G02B 7/183 343/882 |

* cited by examiner

WIDE SCAN STEERABLE ANTENNA

CROSS-REFERENCE TO RELATED APPLICATIONS

This application claims priority of U.S. Provisional Application for Patent No. 62/048,302 filed Sep. 10, 2014, the content of which is incorporated herein by reference in its entirety.

FIELD OF THE INVENTION

The present invention relates to the field of antenna systems, and is more particularly concerned with steerable antennas for transmitting and/or receiving electromagnetic signals.

BACKGROUND OF THE INVENTION

It is well known in the art to use steerable (or tracking) antennas to communicate with a relatively moving target over a wide scan angle. Especially in the aerospace industry, such steerable antennas preferably need to have high gain, low mass, and high reliability. The antennas used in wide scan applications typically include two rotation axes requiring two rotary joints, cable cassettes or other means of propagating the signal over each of the rotation axis. The elimination or the reduction of the number of RF (radio-frequency) rotary joints is highly desirable from a cost, signal loss and reliability perspective. Some solutions have been developed to eliminate rotary joints in wide angle steerable antennas but they are affected by the presence of a singularity which affects the ability to track a target when the beam becomes substantially aligned with one of the rotation axes. This singularity is referred to as the key-hole effect, because of the time required for the rotation around the axis presenting a singularity to keep up with the target rate of motion. Generally, for satellite based systems, this singularity is associated with the use of an azimuth rotation axis that points to the earth (sub-satellite point or nadir). For certain missions, this singularity has little impact on the overall system performance or complexity but in many cases, especially when a high gain is required, it can call for very high actuator speed in order to maintain an adequate antenna pointing as the targets gets close to a rotation axis. For a steerable antenna equipped with a nadir pointing azimuth rotation axis, this happens when the satellite ground track passes near the intended target. This can become a driver in the choice of the actuator and increase the complexity of the drive electronics system. Larger rotary actuators with more complex and costly drive electronics are then required. A solution having no rotary joints is illustrated in U.S. Pat. No. 6,747,604 issued on Jun. 8, 2004. This configuration suffers from a key-hole effect or singularity at nadir (pointing towards the Earth center for an antenna mounted on an Earth facing panel of an orbiting spacecraft) since one of the rotation axis is pointing towards nadir. The same key-hole effect also applies when a target on a GEO (Geostationary Earth Orbit) orbit is being tracked from a LEO/MEO (Low/Medium Earth Orbit) orbit.

Another solution having no key-hole or singularity at nadir but a RF rotary joint is shown in FIG. 1 (from US Patent Publication No. US 2014/01014125 A1 dated Apr. 17, 2014). This configuration has a rotary actuator R2 of a second axis A2 being mounted onto the rotary actuator R1 of the first axis A1, and still requires the use of either a cable cassette, slip ring, mobile harness or the like to transmit power and/or signal over the first rotation axis to/from the second rotary actuator, which approach incurs additional weight, mechanical/electrical complexity, limited pointing range and envelope, not saying additional overall cost.

Accordingly, there is a need for an improved steerable antenna configuration.

SUMMARY OF THE INVENTION

It is therefore a general object of the present invention to provide an improved steerable antenna architecture, or configuration, for optimal steering of transmitting and/or receiving beams over wide scan angles.

An advantage of the present invention is that the architecture is capable of steering the beam nearly over a full hemisphere ($2\pi$ steradians).

Another advantage of the present invention is that, depending on the configuration, there are no singularities or key-holes within the coverage area, therefore avoiding the need for high speed actuation of the rotary actuators and the associated complexity and cost.

A further advantage of the present invention is that the antenna architecture eliminates the need for an RF signal rotary mechanism such as RF rotary joint or flexible waveguide or flexible RF cable, slip ring or the like, therefore improving the reliability of the antenna system.

Still another advantage of the present invention is that the geometry of the antenna can be optimized to minimize the mass and size (and overall envelope) of the antenna moving parts.

Yet another advantage of the present invention is that the rotary actuators for both axes of rotation are fixed, on a stationary side of the antenna, thus eliminating the need of movable harnesses.

According to an aspect of the present invention there is provided an antenna configuration for steering of a transmit and/or receive electromagnetic signal beam over wide scan angles within a pre-determined coverage area of the antenna, said antenna configuration comprising:

- a support structure for mounting on a platform and defining a stationary side of the antenna configuration;
- a transmitting and/or receiving signal feed chain mounting on the support structure;
- a reflector assembly movably mounting on the support structure about first and second axes of rotation, the first and second axes of rotation being generally perpendicular to one another; and
- a first actuator rotating the reflector assembly, and a second actuator rotating a main reflector of the reflector assembly about the second axis of rotation, the first and second actuators fixedly mounting on the support structure.

In one embodiment, the reflector assembly includes the main reflector movably mounted relative to a sub-reflector thereof.

Conveniently, the main reflector is rotatably mounted relative to the sub-reflector, the main reflector rotating about both the first and second axes of rotation and the sub-reflector rotating only about the first axis of rotation.

Conveniently, the reflector assembly includes a splash reflector fixedly mounted onto the main reflector, the splash reflector reflecting the signal beam between the main reflector and the sub-reflector.

In one embodiment, the sub-reflector defines first and second focal points thereof, the first and second focal points substantially lying on the first and second axes of rotation, respectively.

Conveniently, the first focal point substantially lies on a feed source of the feed chain.

In one embodiment, the first axis of rotation is substantially aligned with a feed source of the feed chain, and the second axis of rotation is substantially aligned with a reflection of the feed source on the sub-reflector.

In one embodiment, the first and second actuators are rotary actuators.

In one embodiment, the second axis of rotation is rotated about the first axis of rotation by the first actuator.

In one embodiment, the first and second axes of rotation are co-planar.

In one embodiment, the reflector assembly is connected to the first actuator via a gear assembly, the main reflector being rotatably mounted onto the gear assembly about the second axis of rotation via a bearing assembly.

In one embodiment, the main reflector is connected to the second actuator via a gear assembly.

Conveniently, the gear assembly includes bevel gears.

In one embodiment, the main reflector is connected to the second actuator via a connecting rod and crank assembly.

Conveniently, the connecting rod and crank assembly includes a connecting rod mounted on ball joints.

Conveniently, the connecting rod connects to a substantially outer periphery of the main reflector.

Other objects and advantages of the present invention will become apparent from a careful reading of the detailed description provided herein, with appropriate reference to the accompanying drawings.

BRIEF DESCRIPTION OF THE DRAWINGS

Further aspects and advantages of the present invention will become better understood with reference to the description in association with the following Figures, in which similar references used in different Figures denote similar components, wherein.

DETAILED DESCRIPTION OF THE INVENTION

Figure 1:
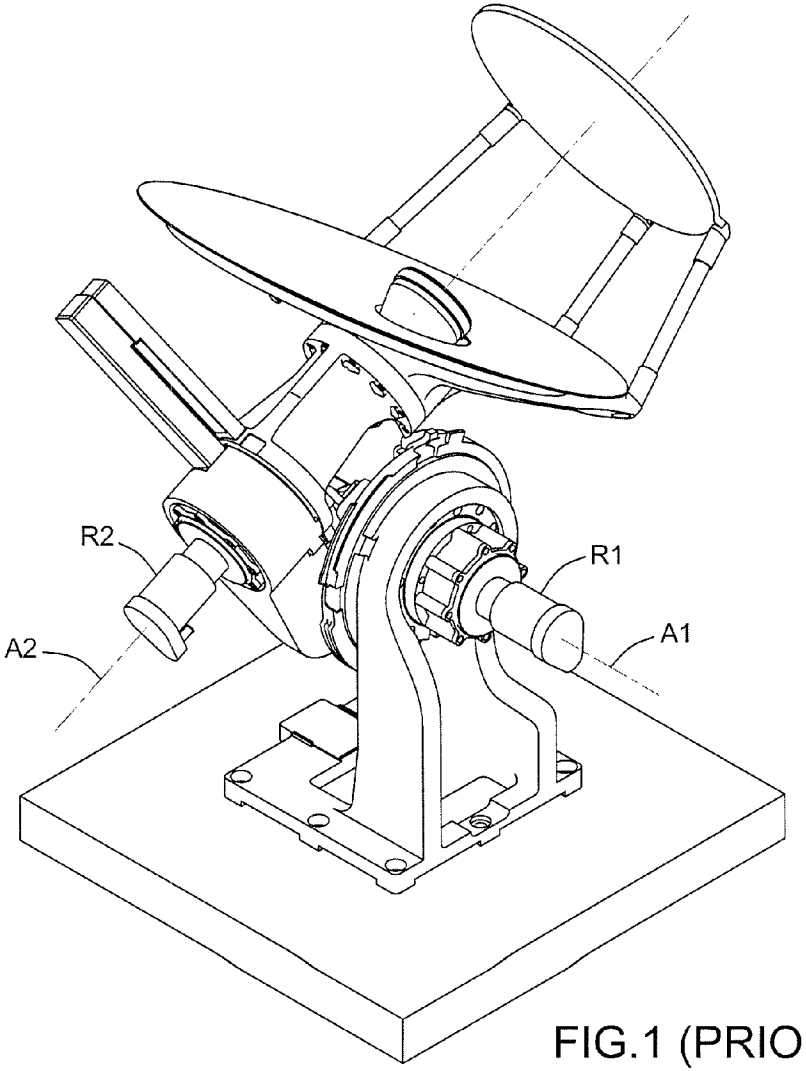
FIG.1 (PRIOR ART)
FIG. 1 is a top perspective view of a prior art steerable antenna having no key-hole singularity but having a rotary joint and a cable cassette (or moveable harness) with a second rotary actuator mounted onto a first rotary actuator.
Figure 2:
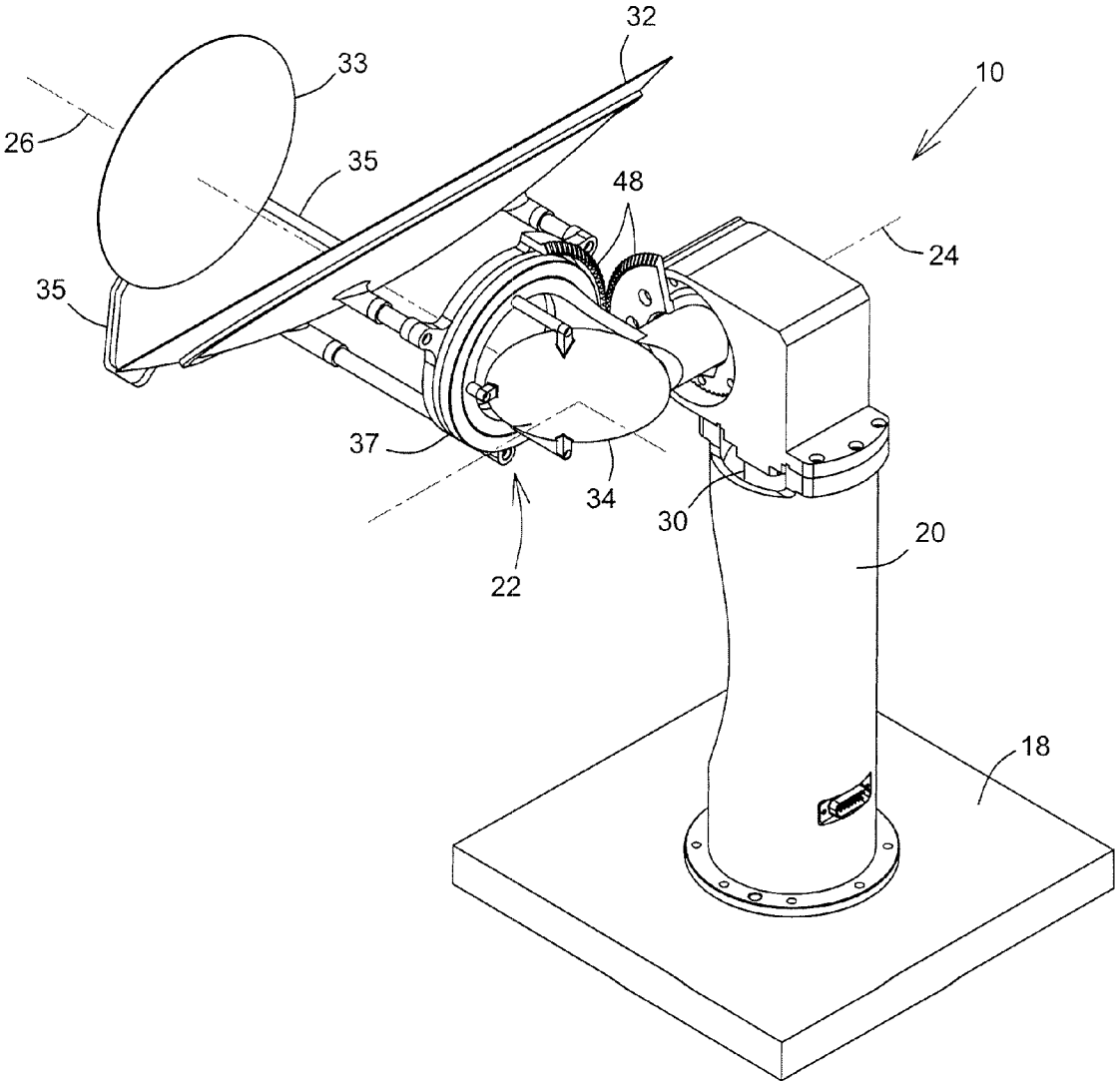
FIG. 2 is a rear top perspective view of a steerable antenna in accordance with an embodiment of the present invention.

With reference to the annexed drawings the preferred embodiment of the present invention will be herein described for indicative purpose and by no means as of limitation.

Referring to FIGS. 2 through 6, there is shown a steerable antenna 10 for allowing transmission and/or reception of an electromagnetic signal beam 12, typically over wide scan angles within an antenna coverage region, over a predetermined surface, such as the surface of the Earth when the antenna 10 is located on a spacecraft and/or satellite. The electromagnetic signal S travels through a feed chain 14 and between a feed source 16 and a target (not shown). The target moves within the antenna coverage region in which the antenna signal beam 12 is to be steered.

The antenna 10 includes a support structure 20 (or pedestal) for attaching to a base 18, such as a spacecraft panel or the like. The support structure 20 defines a stationary (non-moving) side of the antenna 10. A transmitting and/or receiving signal feed chain 14, with its feed source 16 mounts on the support structure 20. A reflector assembly 22, typically including a main reflector 32 and a sub-reflector 34, movably mounts on the support structure 20 about first 24 and second 26 axes of rotation, being generally perpendicular to one another and co-planar. A first actuator 28 rotates the reflector assembly 22 about at least the first 24 of rotation, and a second actuator 30 rotates the main reflector 32 about the second 26 axis of rotation such that the second 26 axis of rotation is rotatable around the first 24 axis of rotation. The first 28 and second 30 actuators fixedly mount on the support structure 20, i.e. on the stationary side of the antenna 10. Typically, the first 28 and second 30 actuators are rotation (or rotary) actuators.

Figure 3:
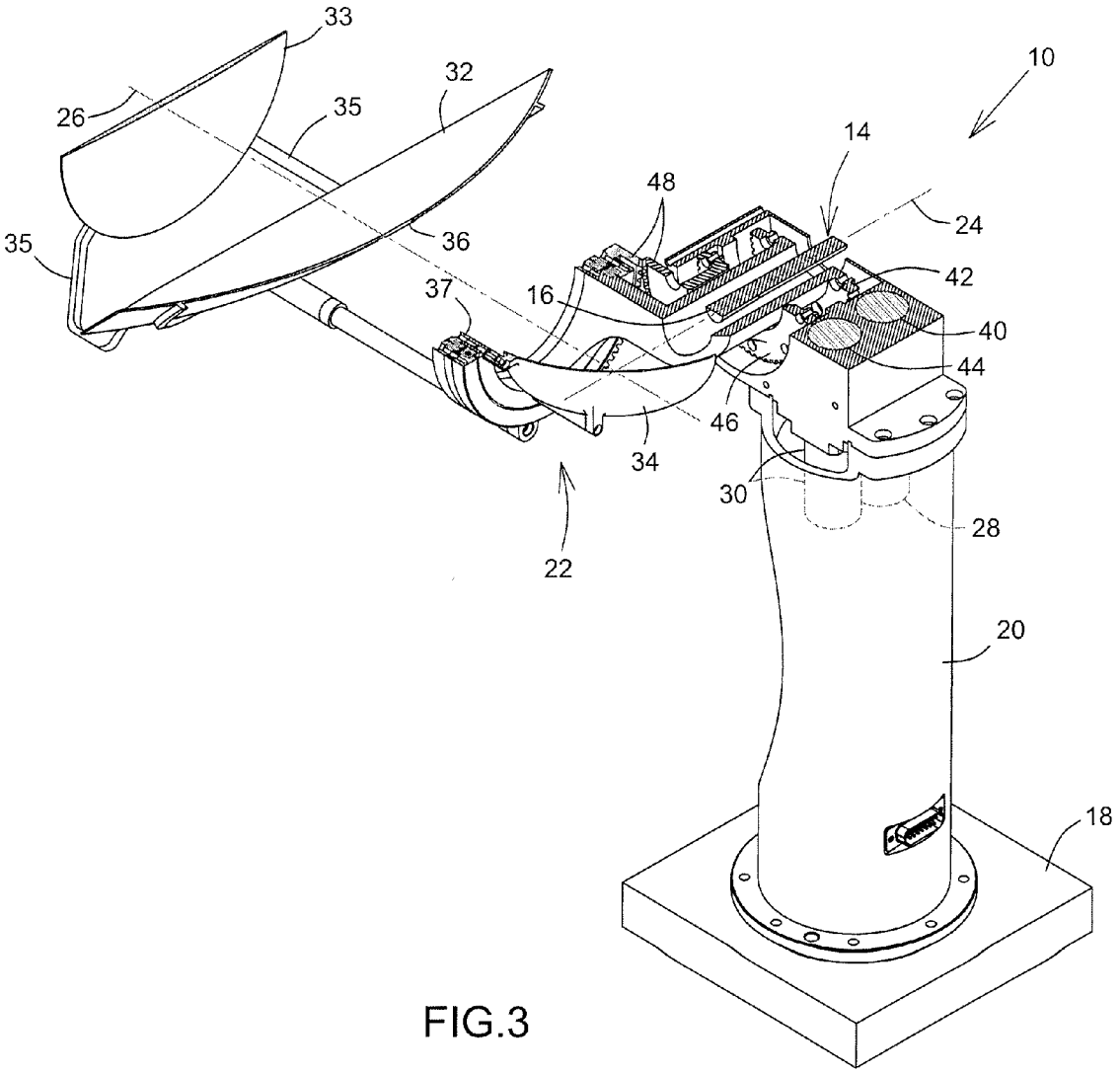
FIG. 3 is a sectioned rear top perspective view of the embodiment of FIG. 2.
Figure 4:
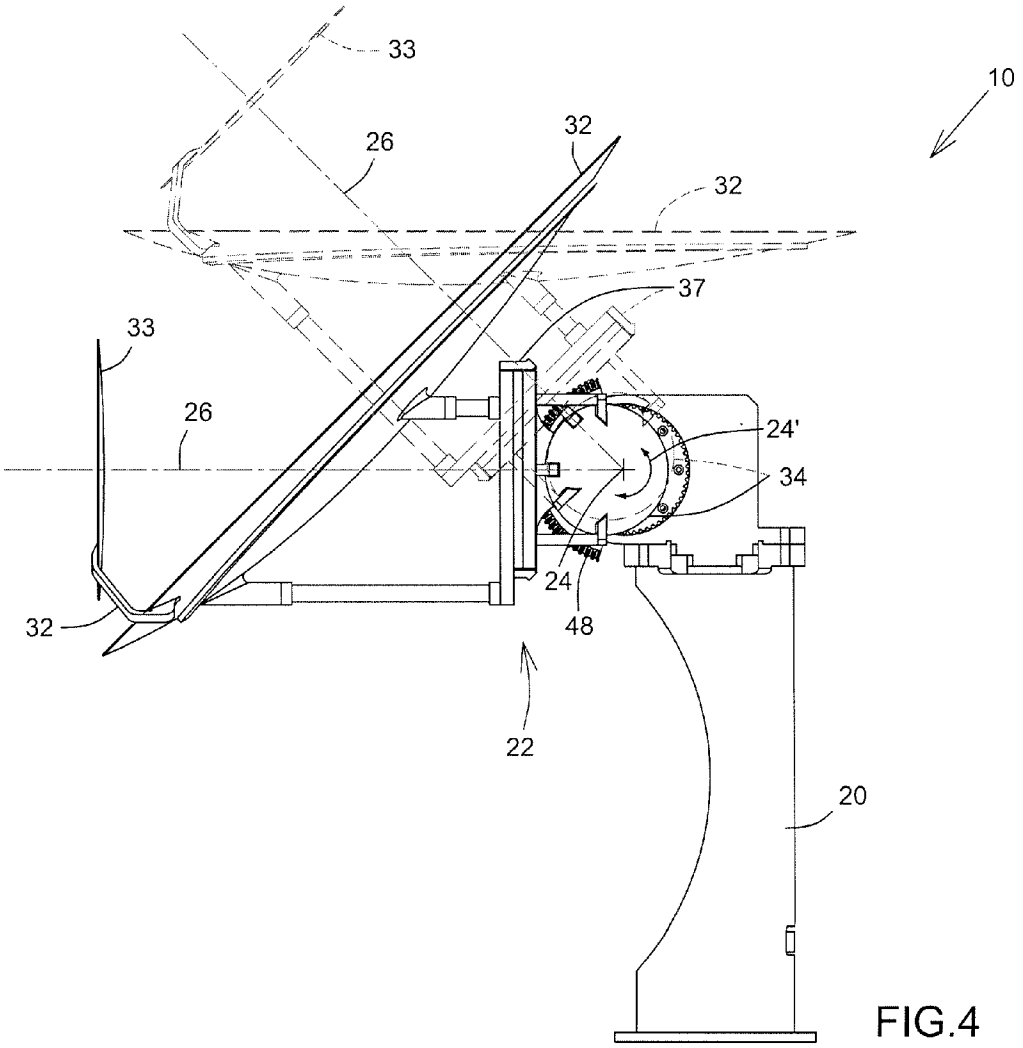
FIG. 4 is a right elevation view of the embodiment of FIG. 2, showing the motion of the elevation axis actuator.
Figure 5:
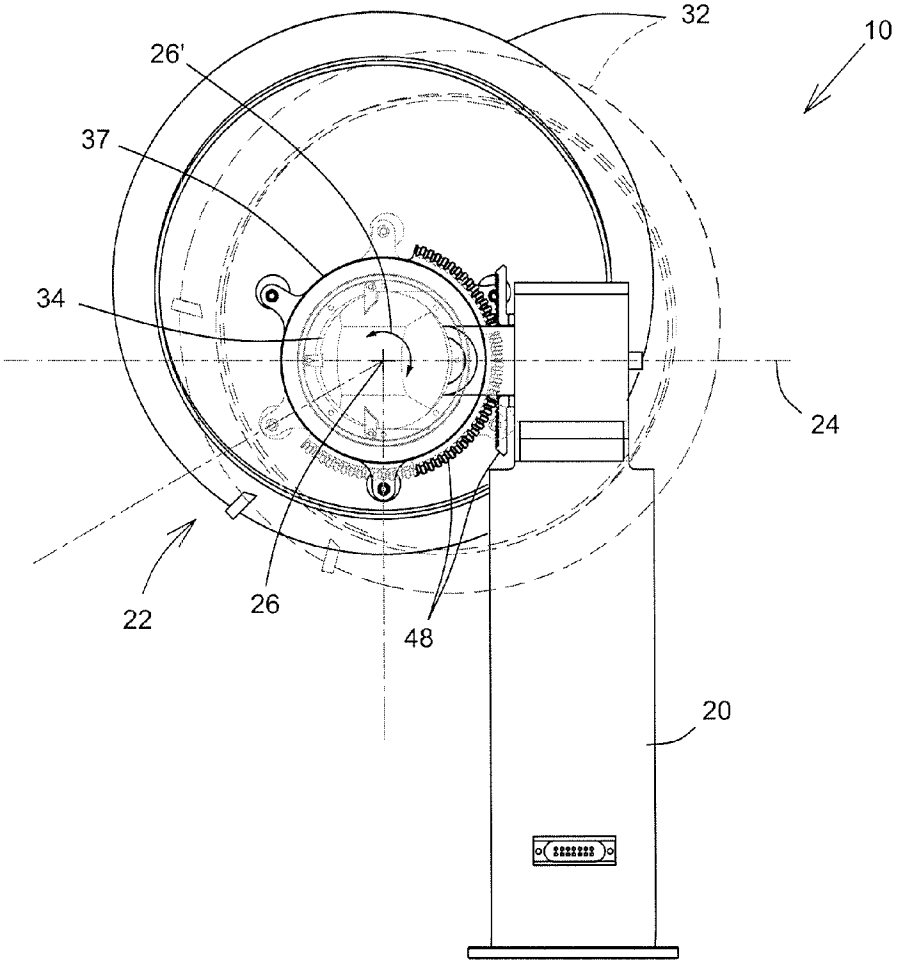
FIG. 5 is a rear elevation view of the embodiment of FIG. 2, showing the motion of the cross-elevation axis actuator.
Figure 6:
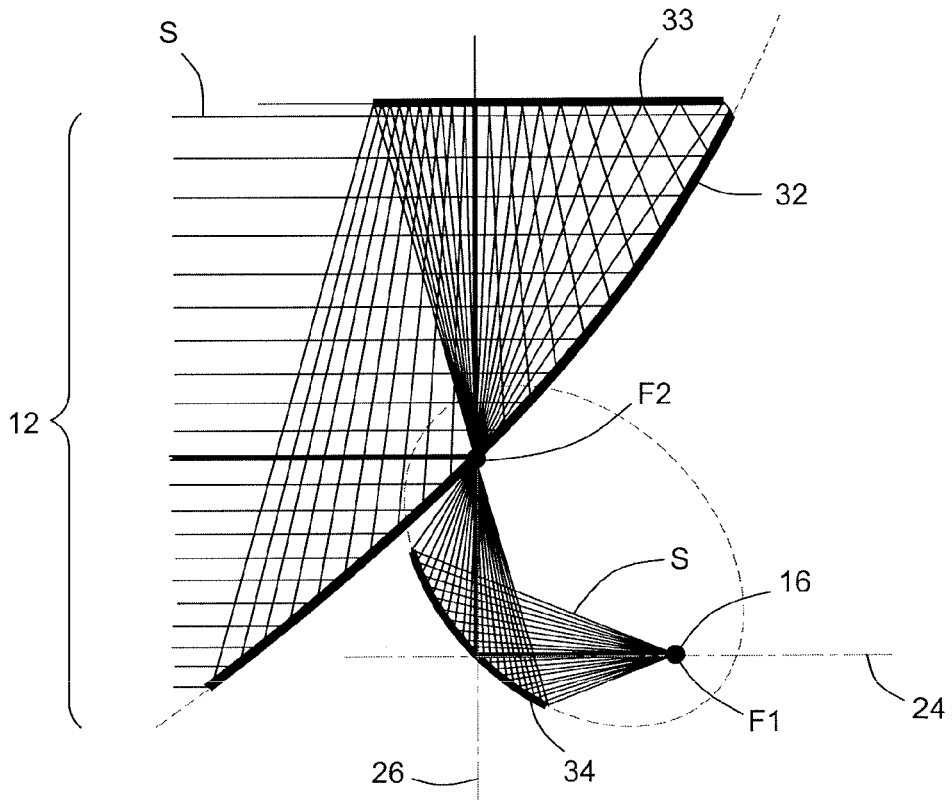
FIG. 6 is a schematic top perspective view of the signal propagation of the antenna of FIG. 2 with the position cross-elevation actuator rotated 90 degrees, to have the antenna pointing at the right side of the antenna instead of pointing at nadir (top)

As better seen in FIGS. 3 to 5, the reflector assembly 22 typically includes the main reflector 32 movably mounted relative to the sub-reflector 34, In the embodiment 10 shown, the main reflector 32, along with a splash reflector 33 connected thereto via mounting struts 35, rotates about both the first 24 and second 26 axes of rotation, while the sub-reflector 34 rotates only about the first axis 24 of rotation, Accordingly, the main reflector 32 typically rotatably mounts onto the sub-reflector 34 via a bearing assembly 37. Accordingly, as shown in FIG. 6, the signal S coming from the feed source 16 and reflected by the sub-reflector 34 propagates towards the splash reflector 33 via a small signal opening 36 extending through the main reflector 32, before it is reflected onto the main reflector 32 towards the target. In this configuration, both first 24 and second 26 axes of rotation should never be aligned with nadir (direction of pointing generally perpendicular to the base 18).

Referring more specifically to FIG. 3, the worm 40 of the first actuator 28, namely the elevation (EL) actuator, meshes with a corresponding EL worm gear 42 carrying the whole reflector assembly 22 for its rotation about the EL axis 24 (as exemplified by double arrow 24' in FIG. 4, showing a second position of the reflector assembly 22 in dotted lines). Similarly, the worm 44 of the second actuator 30, namely the cross-elevation (X-EL—i.e. perpendicular to the EL axis 24) actuator, meshes with a corresponding X-EL worm gear 46 (also rotating about the EL axis 24) carrying only the main 32 and splash 33 reflectors (fixed relative to one another) for their rotation about the X-EL axis 26, via a set of bevel gears 48 or the like (as exemplified by double arrow 26' in FIG. 5, showing a second position of the main 32 and splash 33 reflectors in dotted lines). Obviously, because of the bevel gears 48, when the reflector assembly 22 is rotated about the first axis of rotation 24 via the first actuator 28, the main reflector 32 (and the splash reflector 33) is also being simultaneously rotated about the second axis of rotation 26.

Typically, the sub-reflector 34 has a shape that defines first and second focal points F1, F2, such that any signal coming from one of the focal points F1, F2 and reflected by the sub-reflector 34 passes at the other one of the focal points F2, F1, such that the feed source 16 is aligned with the first axis of rotation 24 and a reflection of the feed source is substantially aligned with the second axis of rotation 26. Accordingly, the main reflector 32, splash reflector 33, and sub-reflector 34 are arranged in such a fashion as to create the focal point F1 substantially at the feed source 16. The arrangement of the main reflector 32 and splash reflector 33, which have a symmetry plane, forms the axis of rotation 26 that substantially includes the second focal point F2, while maintaining the focal point F1 at the feed source 16. The arrangement of the sub-reflector 34 and feed 16 creates the axis of rotation 24 that substantially includes the first focal point F1 and maintains it at the feed source 16 (with the feed source 16 being substantially aligned with the first axis of rotation 24). Rotation of the main reflector 32, splash-plate 33, and sub-reflector 34 about these axes 24, 26 do not perturb the geometric focal point F1. The fact that the focal point F1 remains fixed at the feed source 16 location during rotation of the reflectors 32, 33, 34 about their axes 24, 26 of rotation allows the feed source 16 to remain fixed. In other words, the movement of the reflectors 32, 33, 34 about their axes 24, 26 of rotation scans the beam 12 over the coverage area while the feed source 16 remains stationary on the support structure 20.

The term focal point F1, F2, in addition to referring to a physical point, may also practically refer to a focal area or region.

Figure 7:
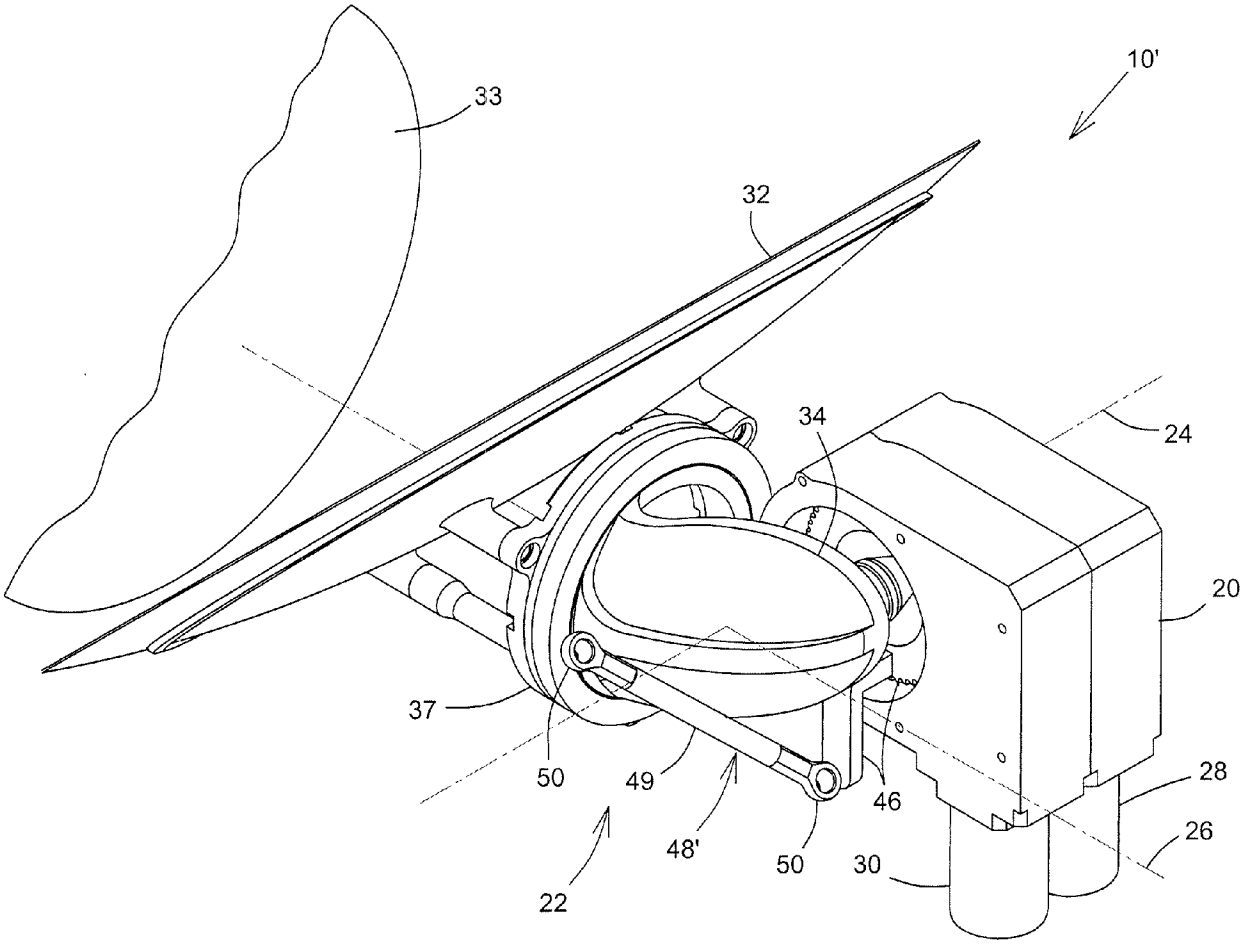
FIG. 7 is a partially broken enlarged top perspective view of a steerable antenna in accordance with another embodiment of the present invention.

Referring more specifically to FIG. 7, there is shown an antenna configuration in accordance with another embodiment 10' of the present invention, in which the set of bevel gears 48 is replaced by a connecting rod assembly 48' including a connecting rod 49 connected to both the X-EL worm gear 46 and the bearing assembly 37 of the main reflector 32 via respective spherical ball joints 50 or the like.

Figure 8A:
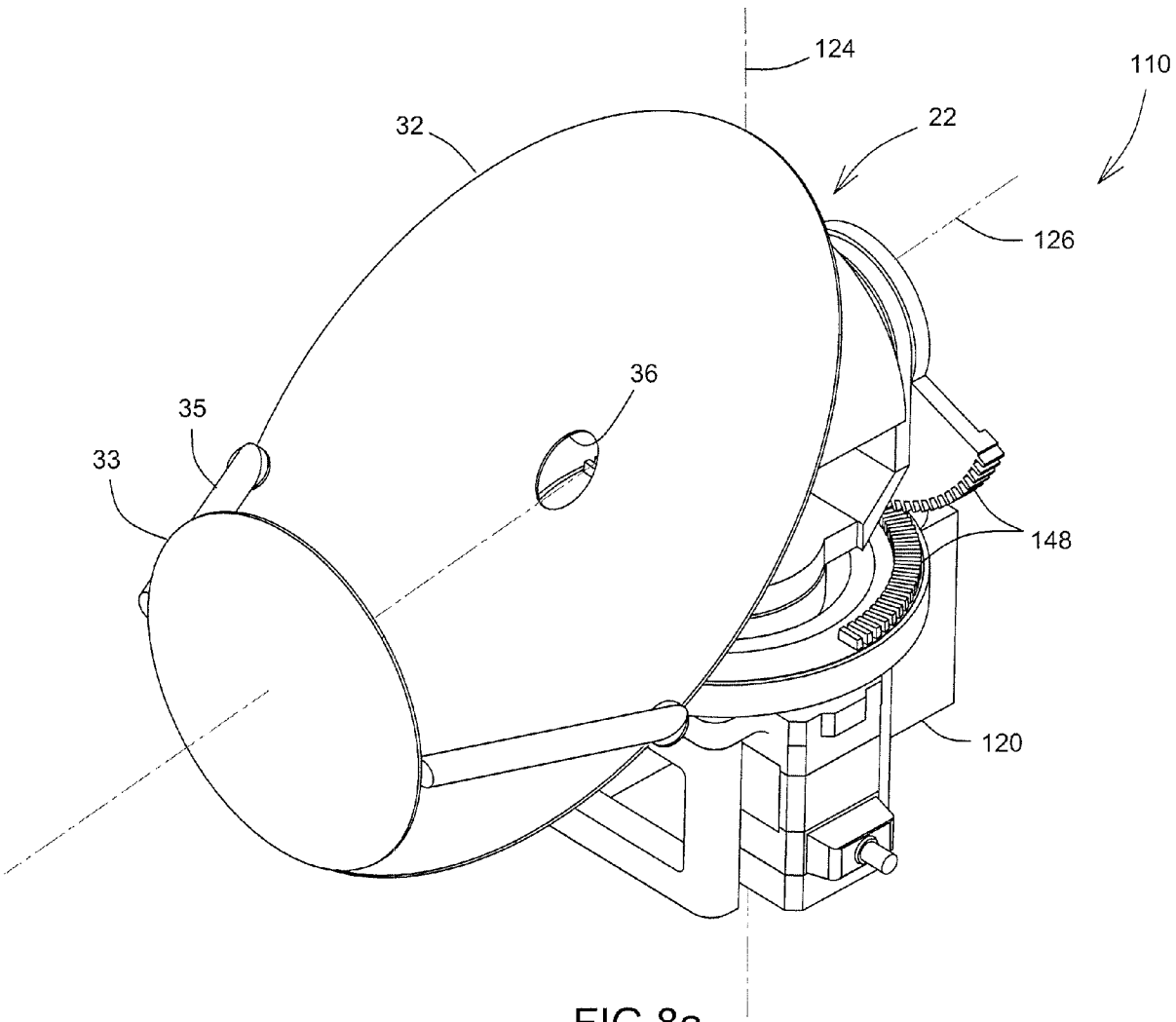
FIGS. 8*a* and 8*b* are front and rear top perspective views of a steerable antenna in accordance with another embodiment of the present invention.
Figure 8B:
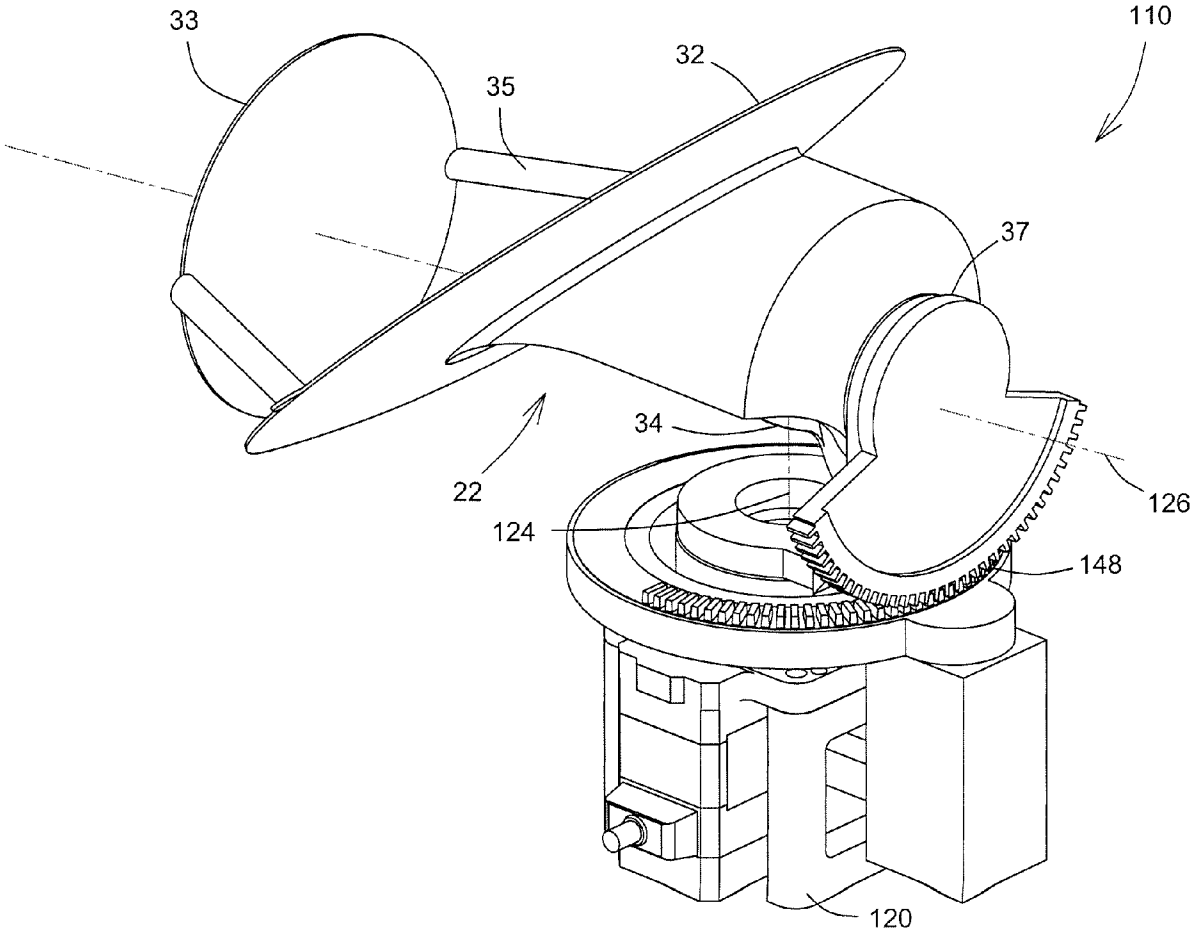

Now referring more specifically to FIGS. 8*a* and *b*, there is shown an antenna configuration in accordance with another embodiment 110 of the present invention, in which the axis configuration is slightly different relative to the first embodiments 10, 10'. In this embodiment 110, although both actuators are still mounted on the stationary support structure 120, the first axis 124 of rotation, the azimuth (AZ) axis, is generally perpendicular to the mounting panel, while the second axis 126 of rotation, the elevation (EL) axis in this case, is generally perpendicular to the AZ axis 124. Similarly to the first embodiments 10, 10', the main 32 and splash 33 reflectors (and mounting struts 35) are rotated about the EL axis 126 via a set of bevel gears 148, with the EL axis 126 extending through an opening 36 of the main reflector 32. This embodiment 110 presents the same benefits as the first embodiments 10, 10' except that for the presence of a key-hole at nadir since the AZ axis 124 points toward nadir.

Figure 9:
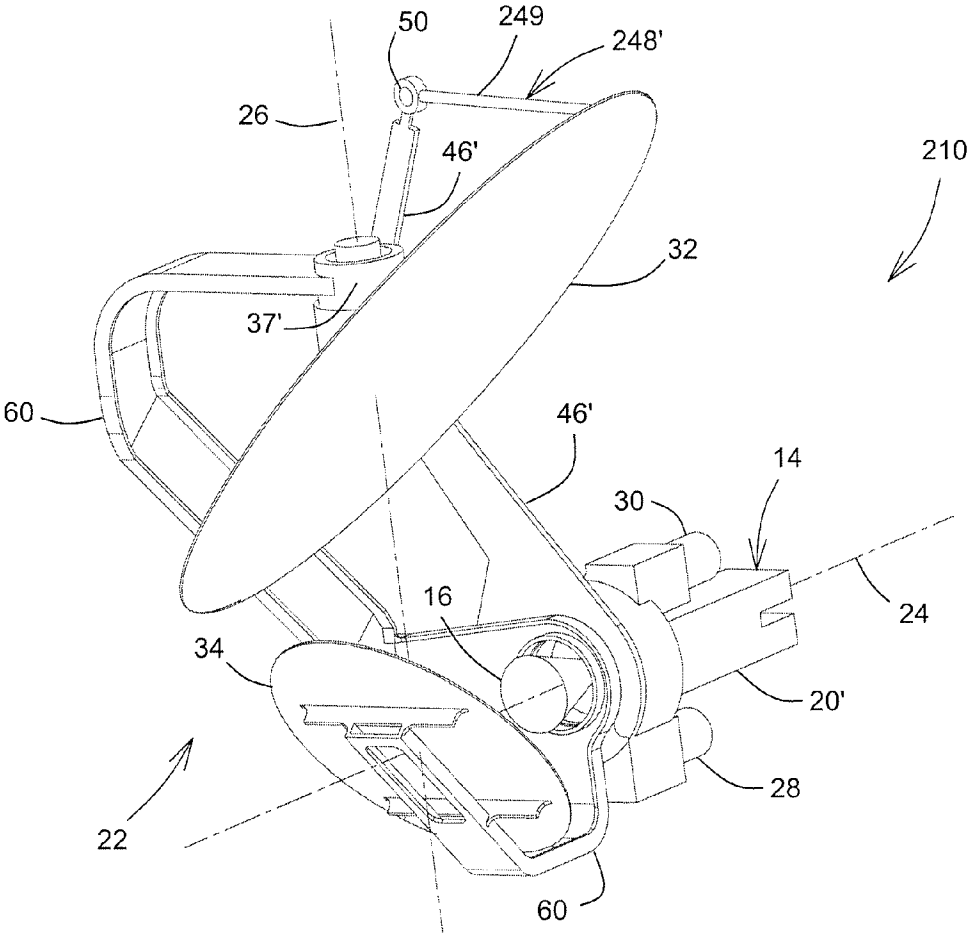
FIG. 9 is front top perspective view of a steerable antenna in accordance with another embodiment of the present invention.
Figure 10:
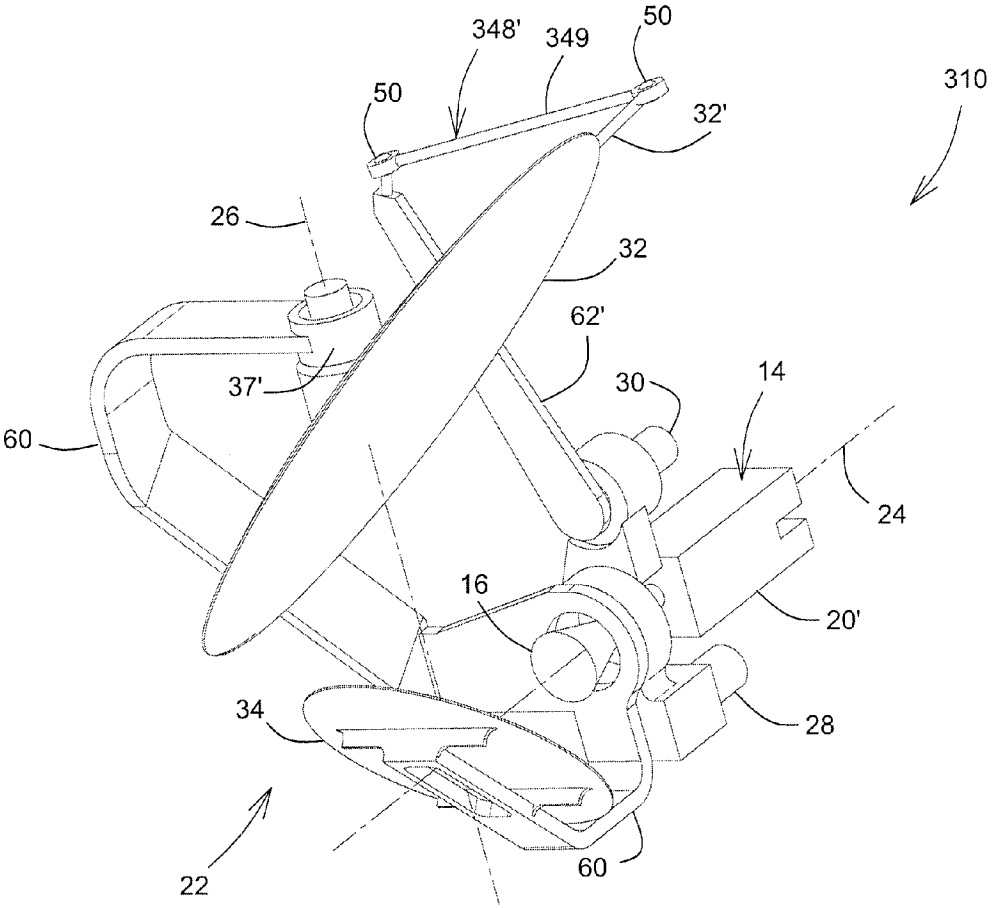
FIG. 10 is front top perspective view of a steerable antenna in accordance with another embodiment of the present invention.
Figure 11:
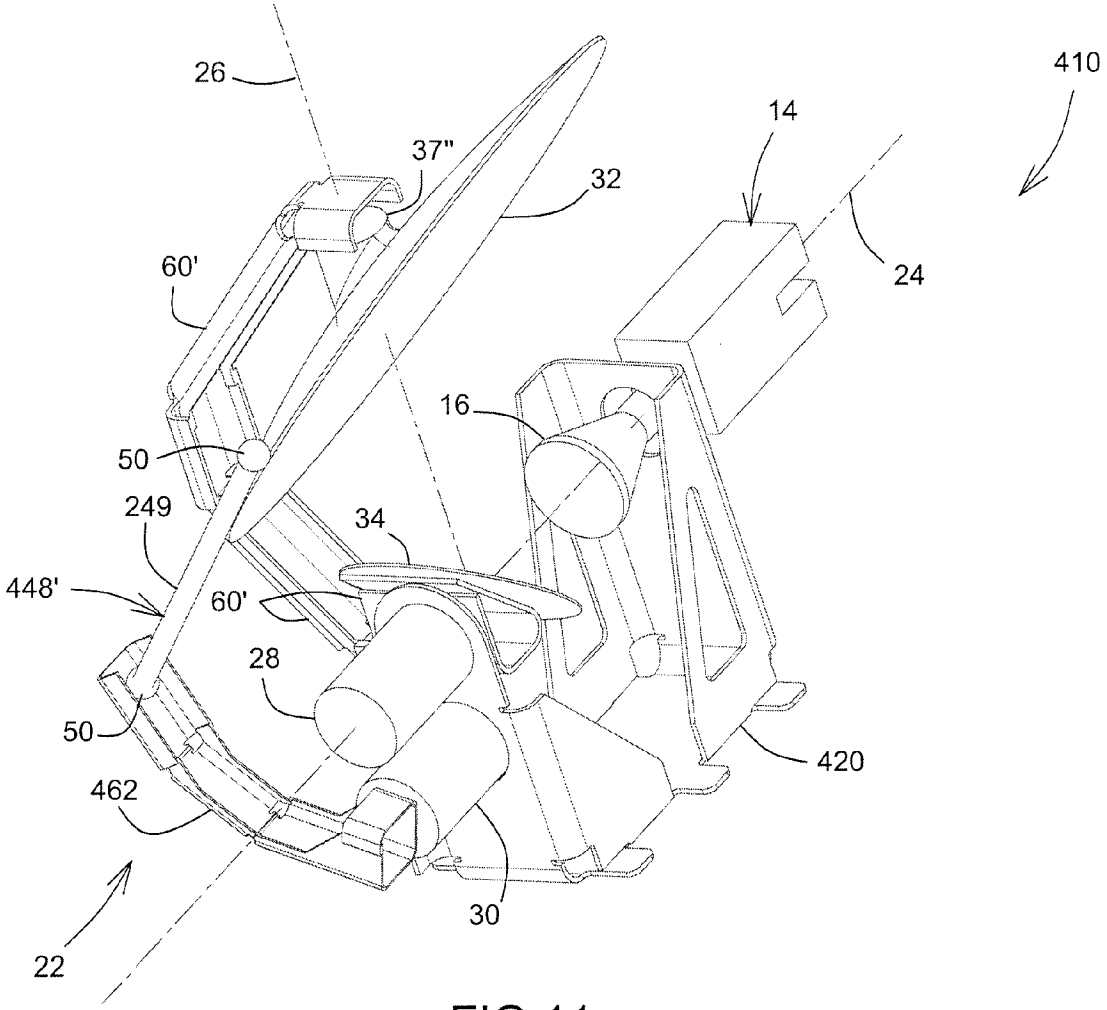
FIG. 11 is front top perspective view of a steerable antenna in accordance with another embodiment of the present invention.

In FIGS. 9, 10 and 11, there are shown antenna configurations in accordance with other embodiments 210, 310, 410 of the present invention, in which the general configuration is slightly different relative to the other embodiments 10, 10', 110 in that the reflector assembly 22 includes only a main reflector 32 and a sub-reflector 34 (generally planar in the present cases) reflecting the signal between the main reflector 32 and the horn feed source 16. In these configurations, the reflector assembly 22 rotates about the first EL axis 24, via the first rotary actuator 28, while only the main reflector 32 rotates about the second X-EL axis 26 via the second rotary actuator 30, The structure 60, 60' between the sub-reflector 34 and the main reflector 32 is also part of the reflector assembly 22, with the main reflector 32 essentially rotatably mounted on the structure 60, 60' via a bearing assembly 37', 37" to allow its rotation relative thereto about the X-EL axis 26. The first 28 and second 30 actuators are fixedly mounted on the support structure 20', 420, i.e. on the stationary side of the antenna 210, 310, 410.

Now referring more specifically to FIG. 9, the two actuators 28, 30 are connected to respective bull gears (not shown) having axes that are co-axial. The bull gear assembly of the second actuator 30 rotates a connecting rod and crank assembly that includes a bracket 46' (or crank) around first axis 24. Bracket 46 is linked to the substantially outer periphery of the main reflector 32 via a connecting rod assembly 248' including a connecting rod 249 mounted with ball joints 50.

Now referring more specifically to FIG. 10, the antenna 310 is essentially similar to the antenna 210 of FIG. 9 except that the axis of the output of the second actuator 30 is offset from the first axis 24 while parallel thereto. Consequently, the output of the second actuator 30 carries a bracket 62' (or crank) linked to an arm 32' fixedly extending from the periphery of the main reflector 32 via a connecting rod assembly 348' including connecting rod 349 mounted with ball joints 50.

Now referring more specifically to FIG. 11, the antenna 410 is essentially similar to the antenna 310 of FIG. 10 except that the two actuators 28, 30 are fixedly mounted onto the support structure 420 on the opposite side from the feed chain 14 relative to the sub-reflector 34 with their axes parallel to one another. Accordingly, the reflector assembly 22 is connected to the first EL actuator 28 via bracket 60' for rotation thereof about the first EL axis 24, and the main reflector 32 being rotatably mounted onto the bracket 60' via bearing assembly 37" for its rotation about the second X-EL axis 26 via the second actuator 30 rotating the bracket 462 connected to the periphery of the main reflector 32 via a connecting rod assembly 448' including a connecting rod 249, mounted with ball joints 50.

Although the rotary actuators are shown to activate respective spindle, worm gear and bevel gears, one skilled in the art would readily understand that any other means of transmission of movement could be considered without departing from the scope of the present invention. Similarly, one skilled in the art would readily know that any other type or arrangement of reflector assembly could be considered without departing from the scope of the present invention.

As illustrated in the embodiments of FIGS. 9, 10 and 11, the main reflector 32 is positioned facing the sub-reflector 34, thus eliminating the need of the splash reflector 33. Similarly, although not illustrated and as one skilled in the art would realize, without departing from the scope of the present invention, the splash reflector 33 could alternatively be connected to the sub-reflector 34 thereto via mounting struts into which case the main reflector 32 would rotates about the first 24 and second 26 axes of rotation while the splash reflector 33 and sub-reflector 34 would rotate only about the first axis of rotation 24.

Although the reflector assembly 22 is shown to include splash reflector 33, main reflector 32 and sub-reflector 34, it would be obvious to one skilled in the art that, without departing from the scope of the present invention, the reflectors 32, 33, 34 of the present invention also refer to any signal reflecting member such as lens, reflect array or the like providing equivalent beam collimation.

Although the present invention has been described with a certain degree of particularity, it is to be understood that the disclosure has been made by way of example only and that the present invention is not limited to the features of the embodiments described and illustrated herein, but includes all variations and modifications within the scope of the invention as hereinafter claimed.

We claim:

1. An antenna configuration for steering of a transmit and/or receive electromagnetic signal beam over wide scan angles within a pre-determined coverage area of the antenna, said antenna configuration comprising:

a support structure for mounting on a platform and defining a stationary side of the antenna configuration;

a transmitting and/or receiving signal feed chain mounting on the support structure;

a reflector assembly movably mounting on the support structure about first and second axes of rotation, the first and second axes of rotation being generally perpendicular to one another; and a first actuator rotating the reflector assembly, and a second actuator rotating a main reflector of the reflector assembly about the second axis of rotation, the first and second actuators fixedly mounting on the support structure.

2. The antenna configuration of claim 1, wherein the e reflector assembly includes the main reflector movably mounted relative to a sub-reflector thereof.

3. The antenna configuration of claim 2, wherein the main reflector is rotatably mounted relative to the sub-reflector, the main reflector rotating about both the first and second axes of rotation and the sub-reflector rotating only about the first axis of rotation.

4. The antenna configuration of claim 3, wherein the reflector assembly includes a splash reflector fixedly mounted onto the main reflector, the splash reflector reflecting the signal beam between the main reflector and the sub-reflector.

5. The antenna configuration of claim 1, wherein the first and second actuators are rotary actuators.

6. The antenna configuration of claim 2, wherein the first axis of rotation is substantially aligned with a feed source of the feed chain, and the second axis of rotation is substantially aligned with a reflection of the feed source on the sub-reflector.

7. The antenna configuration of claim 2, wherein the sub-reflector defines first and second focal points thereof, the first and second focal points substantially lying on the first and second axes of rotation.

8. The antenna configuration of claim 7, wherein the first focal point substantially lies on a feed source of the feed chain.

9. The antenna configuration of claim 1, wherein the second axis of rotation is rotated about the first axis of rotation by the first actuator.

10. The antenna configuration of claim 1, wherein the first and second axes of rotation are co-planar.

11. The antenna configuration of claim 1, wherein the reflector assembly is connected to the first actuator via a gear assembly, the main reflector being rotatably mounted onto the gear assembly about the second axis of rotation via a bearing assembly.

12. The antenna configuration of claim 1, wherein the main reflector is connected to the second actuator via a gear assembly.

13. The antenna configuration of claim 12, wherein the gear assembly includes bevel gears.

14. The antenna configuration of claim 1, wherein the main reflector is connected to the second actuator via a connecting rod and crank assembly.

15. The antenna configuration of claim 14, wherein the connecting rod and crank assembly includes a connecting rod mounted on ball joints.

16. The antenna configuration of claim 15, wherein the connecting rod connects to a substantially outer periphery of the main reflector.

* * * * *